US006877829B2

(12) United States Patent
Irizarry

(10) Patent No.: US 6,877,829 B2
(45) Date of Patent: Apr. 12, 2005

(54) DRAWER ASSEMBLY AND STORAGE CABINET

(76) Inventor: Abel A. Irizarry, 4027 Stoneybrook La., Edgemoor, SC (US) 28712

( * ) Notice: Subject to any disclaimer, the term of this patent is extended or adjusted under 35 U.S.C. 154(b) by 22 days.

(21) Appl. No.: 10/608,343

(22) Filed: Jun. 27, 2003

(65) Prior Publication Data

US 2004/0263031 A1 Dec. 30, 2004

(51) Int. Cl.[7] ..... A47B 88/00

(52) U.S. Cl. ..... 312/291; 312/107; 312/350; 312/330.1

(58) Field of Search ..... 312/107, 108, 312/330.1, 334.7, 334.13, 334.44, 333, 350, 301, 291

(56) References Cited

U.S. PATENT DOCUMENTS 1,496,099 A * 6/1924 O'Connor ..... 70/86
2,557,630 A * 6/1951 Charles ..... 312/107
D170,965 S 12/1953 Claus
3,041,124 A * 6/1962 Armstrong ..... 312/270.1
3,169,813 A * 2/1965 Cannon et al. ..... 312/270.3
3,241,900 A * 3/1966 Hamilton et al. ..... 312/194
3,586,394 A * 6/1971 Hecksel ..... 384/23
3,888,350 A * 6/1975 Horvath ..... 206/531
D243,981 S 4/1977 Carter
4,047,773 A 9/1977 Semany
D283,084 S 3/1986 Banigan
D326,381 S 5/1992 Heiligenthal et al.
5,244,272 A * 9/1993 Thompson ..... 312/334.23
D340,820 S 11/1993 Frischer
5,322,365 A * 6/1994 Teufel et al. ..... 312/330.1
D365,224 S 12/1995 Pohlman
5,628,552 A * 5/1997 O'Barr ..... 312/330.1
D379,631 S 6/1997 Odom
D379,879 S 6/1997 Quiggins et al.
D410,351 S 6/1999 Magnusson et al.
5,934,466 A * 8/1999 Loeffler ..... 206/372
6,036,291 A * 3/2000 Rock ..... 312/333
D438,047 S 2/2001 Chavez
6,299,008 B1 10/2001 Payne

FOREIGN PATENT DOCUMENTS

JP 7146980 * 6/1995
JP 10000120 * 1/1998

* cited by examiner

*Primary Examiner*—Janet M. Wilkens
(74) *Attorney, Agent, or Firm*—Schwartz Law Firm P.C.

(57) ABSTRACT

A drawer assembly includes a drawer having a bottom wall, first and second opposing end walls, and first and second opposing side walls. The end and side walls cooperate to define an open top for receiving and removing contents. First and second longitudinal top rails are formed with respective first and second side walls. A removable lid covers the open top of the drawer in a first assembly configuration. The lid has first and second opposing major surfaces, first and second opposing end edges, and first and second opposing side edges. The side edges of the lid include respective longitudinal channels adapted for receiving the longitudinal top rails of the drawer to slide the lid over the open top. An indent is formed with at least one of the first and second longitudinal top rails of the drawer. A detent is formed with at least one of the first and second longitudinal channels of the lid. The detent is adapted for mating with the indent of the drawer to temporarily lock the lid in position over the open top of the drawer.

15 Claims, 8 Drawing Sheets

DRAWER ASSEMBLY AND STORAGE CABINET

TECHNICAL FIELD AND BACKGROUND OF THE INVENTION

This invention relates to a drawer assembly and storage cabinet. The invention includes a removable lid secured to the drawer and applicable for reconfiguring the assembly to accommodate the desired application of the user. The drawer assembly is readily removed from the cabinet for use by itself with the lid serving to cover the open top in a first configuration for containing loose items stored in the drawer. The items are accessed by removing the lid from the drawer. When not in use, the lid is conveniently and securely stowed adjacent the bottom of the drawer in either a second or third assembly configuration.

When the drawer is used inside the storage cabinet, the lid may be applied to cover the open top of the drawer to prevent accidental spillage of items in the event the cabinet is inadvertently jostled or overturned. This configuration is especially useful when using the storage cabinet in a vehicle to carry hardware and small tools. In a more stable environment, the drawer assembly may be used inside the cabinet with the lid positioned adjacent the bottom of the drawer. In this configuration, the lid prevents inadvertent sliding of the drawer entirely outwardly from the cabinet cell.

A variety of drawers and storage cabinets are known in the prior art. In most cabinets, the drawers are not intended for use outside the cabinet, and do not utilize a lid for covering the drawer when inside the cabinet. If removed from the cabinet, these prior art drawers typically do not have means for attaching a lid, nor do they have means for conveniently stowing the lid when not in use.

SUMMARY OF INVENTION

Therefore, it is an object of the invention to provide a drawer assembly which includes a removable lid adapted for positioning over the top or adjacent the bottom of the drawer to arrange the assembly in multiple configurations.

It is another object of the invention to provide a drawer assembly designed to fit within a storage cabinet, and including a removable lid for covering an open top of the drawer to contain items stored in the drawer.

It is another object of the invention to provide a drawer assembly which conveniently locates loose items in a front of the drawer for ready access.

It is another object of the invention to provide a drawer assembly which includes means for conveniently stowing the lid when not in use.

It is another object of the invention to provide a drawer assembly which includes means for temporarily locking the lid onto the drawer in both an in-use and non-use position.

It is another object of the invention to provide a drawer assembly which is formed of a durable material, such as clear acrylic plastic, which has slight inherent flex and resilience.

These and other objects of the present invention are achieved in the preferred embodiments disclosed below by providing a drawer assembly including a drawer having a bottom wall, first and second opposing end walls, and first and second opposing side walls. The end and side walls cooperate to define an open top for receiving and removing contents. First and second longitudinal top rails are formed with respective first and second side walls. A removable lid covers the open top of the drawer in a first assembly configuration. The lid has first and second opposing major surfaces, first and second opposing end edges, and first and second opposing side edges. The side edges of the lid include respective longitudinal channels adapted for receiving the longitudinal top rails of the drawer to slide the lid over the open top. An indent is formed with at least one of the first and second longitudinal top rails of the drawer. A detent is formed with at least one of the first and second longitudinal channels of the lid. The detent is adapted for mating with the indent of the drawer to temporarily lock the lid in position over the open top of the drawer.

According to another preferred embodiment, first and second longitudinal bottom rails are formed with respective first and second side walls below respective top rails. The bottom rails are adapted for receiving the longitudinal channels of the removable lid to position the lid adjacent the bottom wall of the drawer in a second assembly configuration.

According to another preferred embodiment, an indent is formed with at least one of the first and second bottom rails of the drawer. The indent is adapted for mating with the detent formed with the longitudinal channel of the lid to temporarily lock the lid in position adjacent the bottom wall of the drawer.

According to another preferred embodiment, each of the longitudinal channels of the lid defines a beveled end adapted to facilitate sliding of the lid onto the drawer.

According to another preferred embodiment, the lid has a pull flange located at one end edge. The pull flange extends vertically outwardly beyond the first major surface of the lid to be pulled by a user to uncover the lid from the open top of the drawer.

In another embodiment, the invention is a storage cabinet defining cells for storing a plurality of like drawer assemblies. Each of the drawer assemblies includes a drawer having a bottom wall, first and second opposing end walls, and first and second opposing side walls. The end and side walls cooperate define an open top for receiving and removing contents. First and second longitudinal top rails are formed with respective first and second side walls. A removable lid is adapted for covering the open top of the drawer in a first assembly configuration. The lid has first and second opposing major surfaces, first and second opposing end edges, and first and second opposing side edges. The side edges include respective longitudinal channels adapted for receiving the longitudinal top rails of the drawer to slide the lid over the open top. First and second indents are formed with respective longitudinal top rails of the drawer. First and second detents formed with respective longitudinal channels of the lid. The detents are adapted for mating with the first and second indents of the drawer to temporarily lock the lid in position over the open top of the drawer.

According to another preferred embodiment, a vertically raised bottom lip is formed at a mouth of each cell.

According to another preferred embodiment, the removable lid further includes a lateral stop located between the first and second end edges, and extending vertically outwardly beyond the first major surface of the lid. When the lid is positioned adjacent the bottom wall of the drawer in a second assembly configuration with the second major surface of the lid facing the bottom wall, the lateral stop engages the bottom lip of the cell to limit outward sliding movement of the drawer from the cabinet.

According to another preferred embodiment, the pull flange of the lid extends beyond the lateral stop. When the drawer is pushed inside the cabinet with the lid positioned adjacent the bottom wall of the drawer in the second assembly configuration, the pull flange tilts the drawer forward thereby moving contents by gravity towards the front of the drawer.

According to another preferred embodiment, a handle is attached to the end wall of the drawer for being pulled by a user to remove the drawer assembly from a cell of the cabinet.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
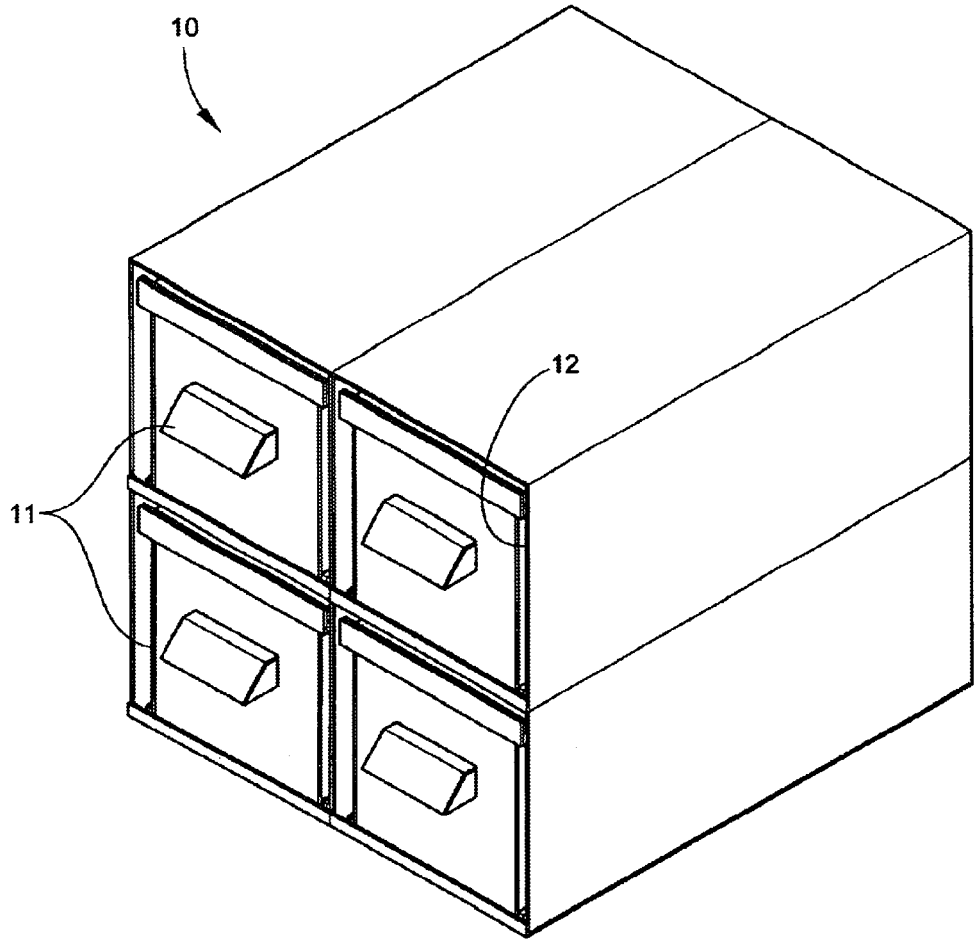
FIG. 1 is a perspective view of a storage cabinet for holding a number of like drawer assemblies according to one preferred embodiment of the present invention.

Referring now specifically to the drawings, a storage cabinet according to the present invention is illustrated in FIG. 1, and shown generally at reference numeral 10. The cabinet 10 holds a number of identical drawer assemblies 11 applicable for storing items such as a hardware, small tools, sewing thread, needles, buttons and the like. While the cabinet 10 shown has four rectangular-shaped drawer cells 12, the invention may be formed in any desired dimension and with any given number of cells.

Figure 2:
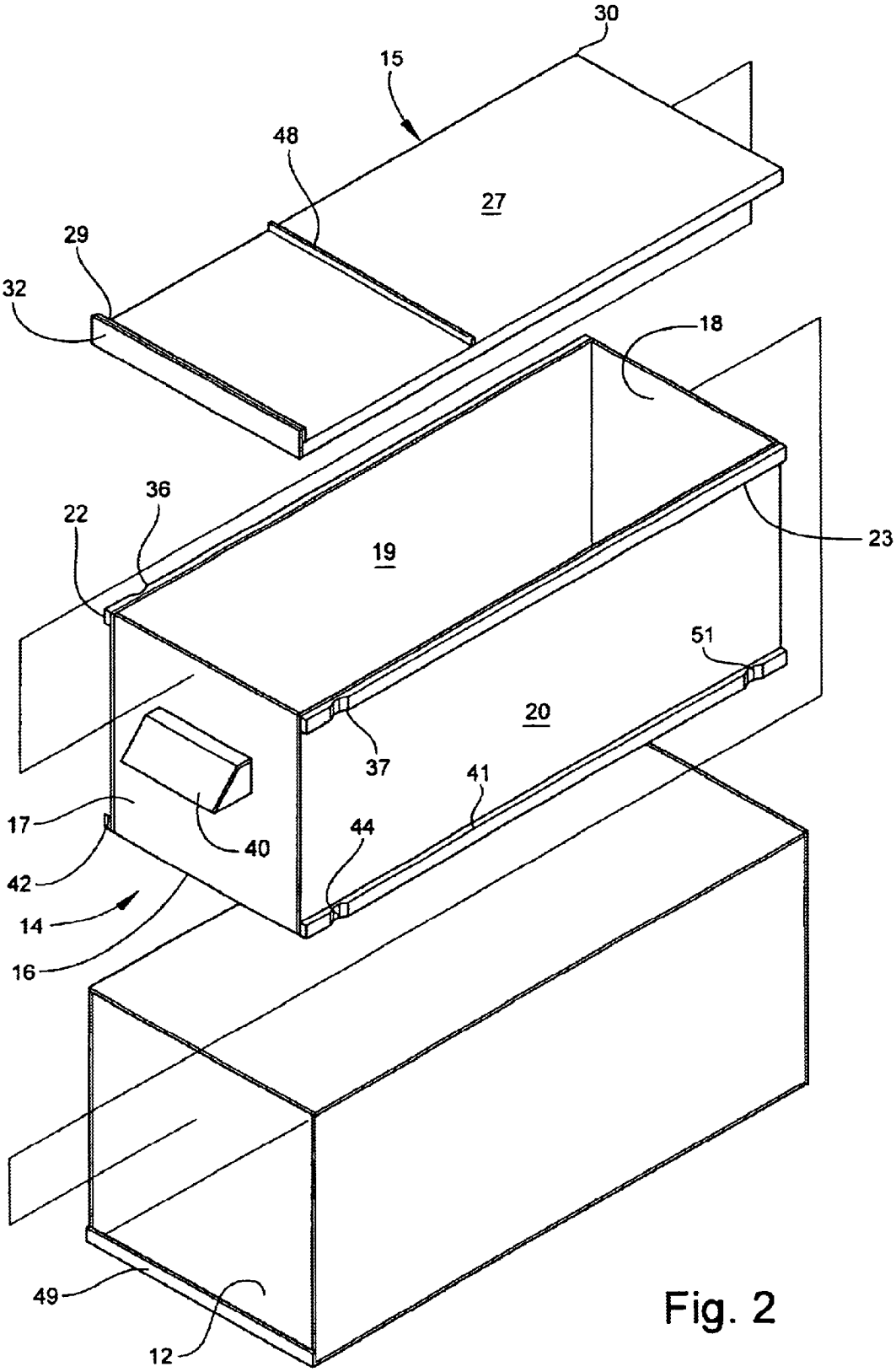
FIG. 2 is a perspective view of the drawer assembly removed from a cell of the storage cabinet and showing the lid removed from the open top of the drawer.
Figures 3, 4, 5:
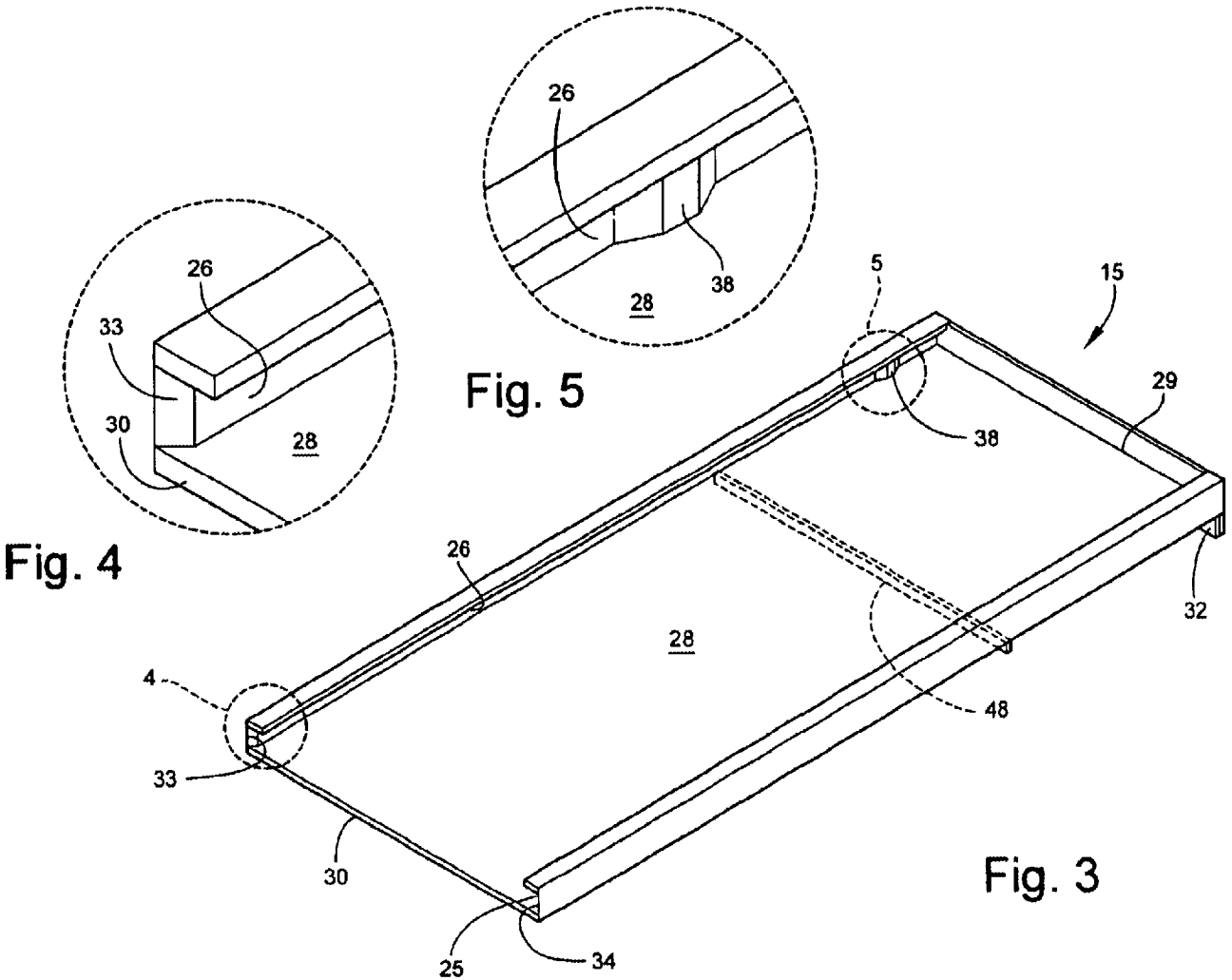
FIG. 3 is a perspective view of the removable lid.
FIG. 4 is an enlarged perspective view showing the beveled end of the longitudinal channel formed with the lid.
FIG. 5 is an enlarged perspective view showing the detent formed inside the lid channel.

As best shown in FIGS. 2 and 3, each assembly 11 includes a drawer 14 and removable lid 15 designed to fit within a single cell 12. The drawer 14 has a bottom wall 16, first and second opposing end walls 17 and 18, and first and second opposing side walls 19 and 20. The end and side walls 17–20 cooperate to form an open top for receiving and removing items. First and second longitudinal top rails 22 and 23 are formed with the side walls 19 and 20, respectively. The top rails 22, 23 are adapted for receiving opposing longitudinal channels 25 and 26 formed with respective side edges of the lid 15, as shown in FIG. 3. The removable lid 15 slides along the top rails 22, 23 to cover and uncover the open top of the drawer 14 in a first assembly configuration. The lid 15 has first and second opposing major surfaces 27 and 28, and first and second opposing end edges 29 and 30 perpendicular to the longitudinal channels 25, 26. A pull flange 32 is formed at the end edge 29 and extends vertically beyond the first major surface 27 to be pulled by a user for applying and removing the lid 15. Preferably, the leading ends 33 and 34 of each longitudinal channel are beveled, as shown in FIGS. 3 and 4, to facilitate sliding of the lid 15 onto the top rails 22, 23 of the drawer 14.

Figures 6, 7:
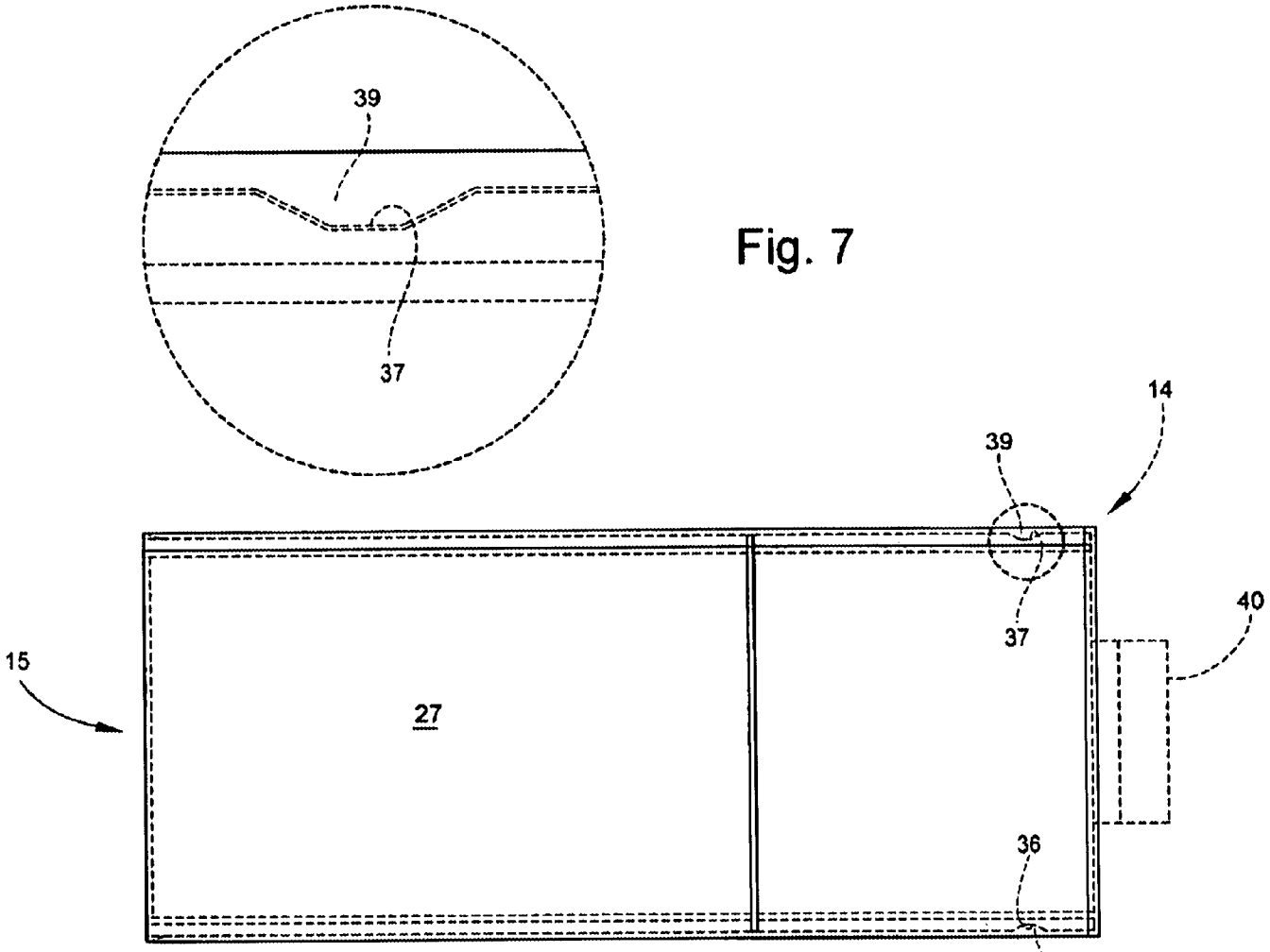
FIG. 6 is a plan view of the drawer assembly with the lid covering the open top and the drawer shown in phantom.
FIG. 7 is an enlarged plan view showing mating alignment of the drawer indent and lid detent which cooperate to temporarily lock the lid in position.

Referring to FIGS. 2, 3, 5, 6 and 7, the top rails 22, 23 have a pair of laterally-opposed indents 36 and 37 designed to mate with corresponding detents 38 and 39 formed in the channels 25, 26 of the lid 15 to temporarily lock the lid 15 in position over the open top of the drawer 14. A single detent 38 is shown in FIG. 5. Mating alignment of the indents 36, 37 and detents 38, 39 is shown in FIGS. 6 and 7. According to one embodiment, the drawer 14 and lid 15 are formed of a material, such as Plexiglas or other acrylic plastic, which has slight inherent flex and resilience sufficient to allow disengagement of the indents 37, 37 and detents 38, 39 when the lid 15 is pulled or pushed outwardly from the drawer 14 using relatively little force. A handle 40 is preferably attached to the end wall 17 to facilitate removal of the lid 15, and entry and removal of the drawer 14 into and from the cabinet cell 12.

Figures 8, 9:
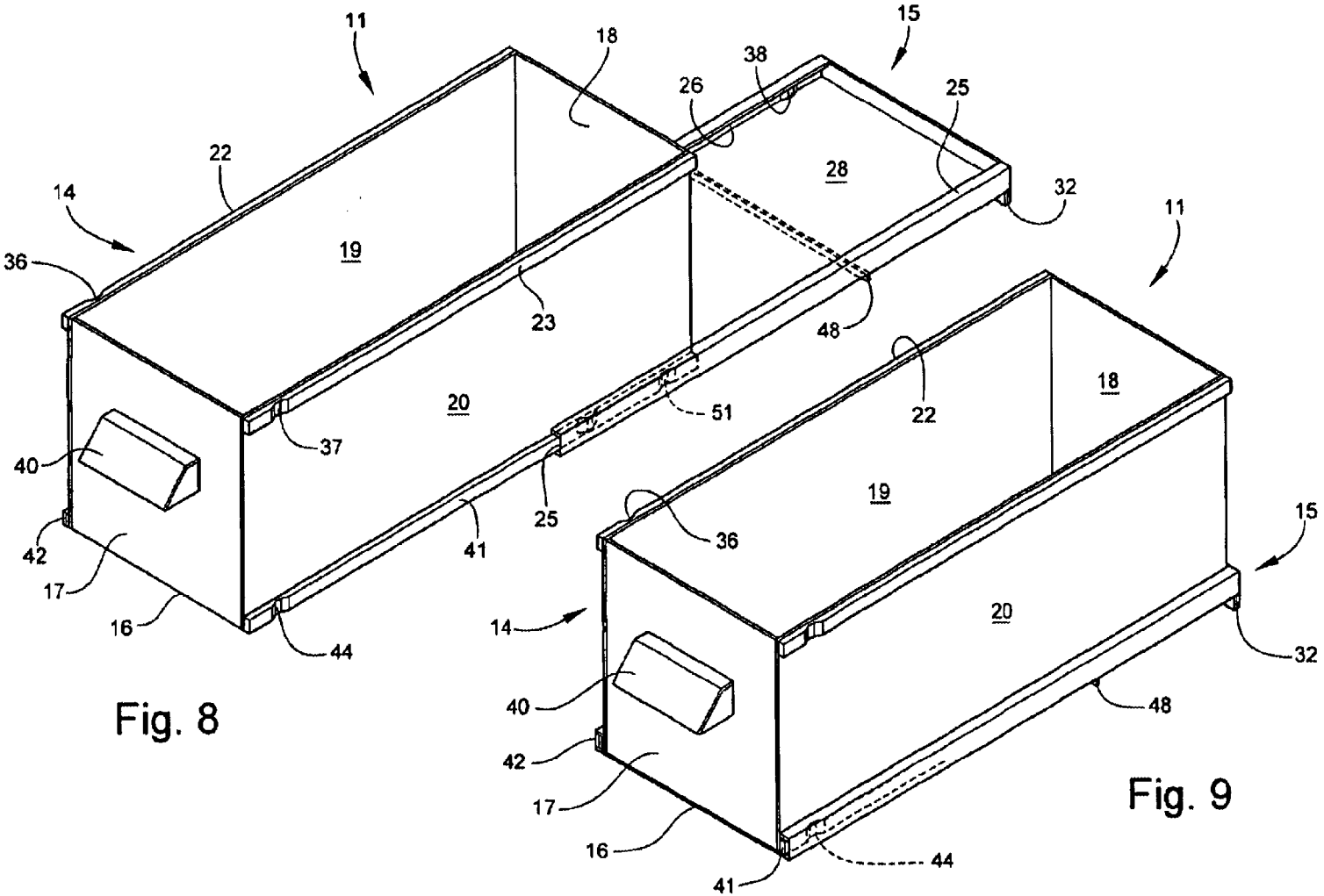
FIG. 8 is a perspective view of the drawer assembly with the lid being applied to bottom rails of the drawer in a second configuration.
FIG. 9 is a perspective view of the drawer assembly in the second configuration.
Figure 10:
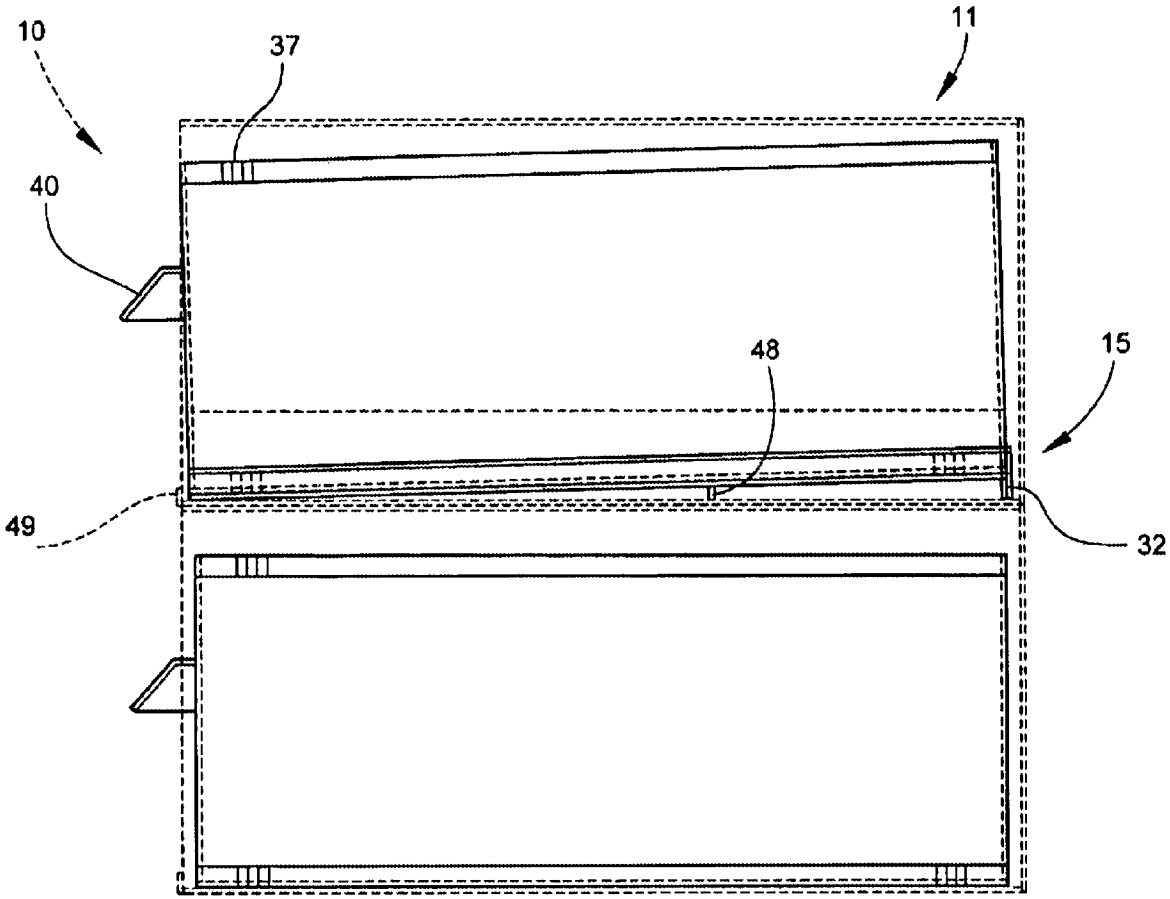
FIG. 10 is a side elevation of the storage cabinet shown in phantom with a top drawer assembly in the second configuration.
Figure 11:
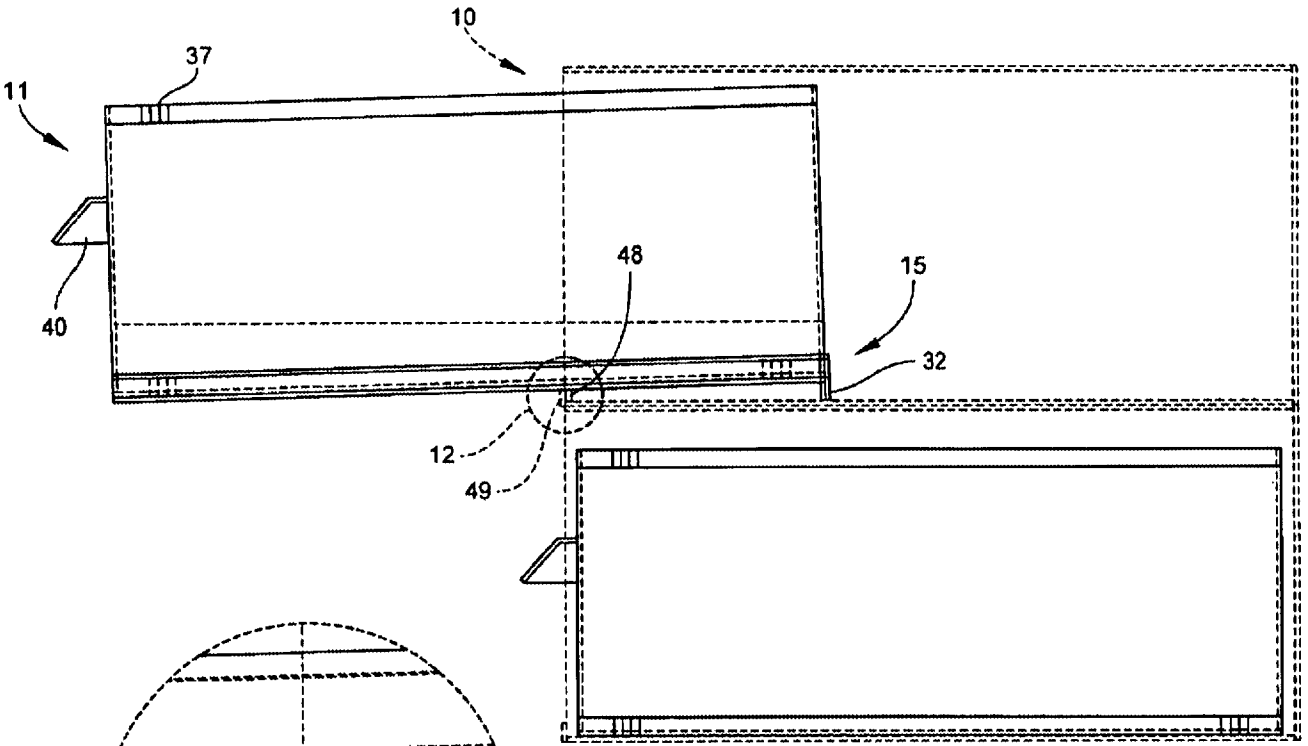
FIG. 11 is a side elevation of the storage cabinet shown in phantom with the top drawer assembly in the second configuration and pulled outwardly from the cabinet cell.
Figure 12:
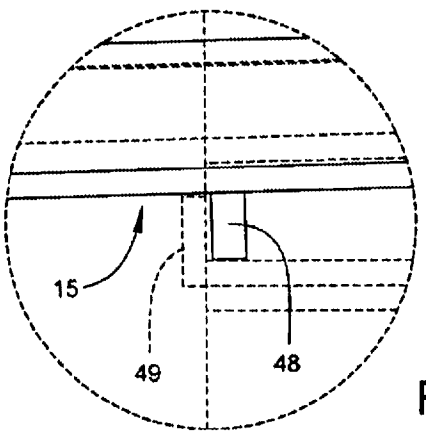
FIG. 12 is an enlarged elevation showing engagement of the lateral drawer stop and cabinet lip cooperating to limit outward sliding movement of the drawer from the cabinet.

FIGS. 8–12 illustrate the assembly 11 in a second configuration with the removable lid 15 inverted, rotated 180 degrees, and applied to bottom longitudinal rails 41 and 42 of the drawer 14. As shown in FIGS. 8 and 9, the lid 15 slides onto the rails 41, 42 from the back of the drawer 14, and is moved forward to align the detents 38, 39 of the lid channels 25, 26 with corresponding laterally-opposed front indents 44 (only one shown) formed with the bottom rails 41, 42. The mating detents 38, 39 and indents 44 cooperate to temporarily lock the lid 15 in position. In this configuration, the second major surface 28 of the lid 15 faces the bottom wall 16 of the drawer 14. When the assembly 11 is located in a cell 12 of the storage cabinet 10, as shown in FIG. 10, the pull flange 32 of the lid 15 serves to tilt the drawer 14 slightly forward such that loose items are directed by gravity towards the front of the drawer 14. Consequently, when the drawer 14 is pulled outwardly from the cabinet 10, as shown in FIG. 11, the user has convenient access to the entire contents. Preferably, a lateral stop 48 is formed with the lid 15 between the first and second end edges 29, 30 and cooperates with a raised vertical lip 49 located at the mouth of the cell 12 to limit outward movement of the drawer 14, as shown in FIGS. 11 and 12.

Figure 13:
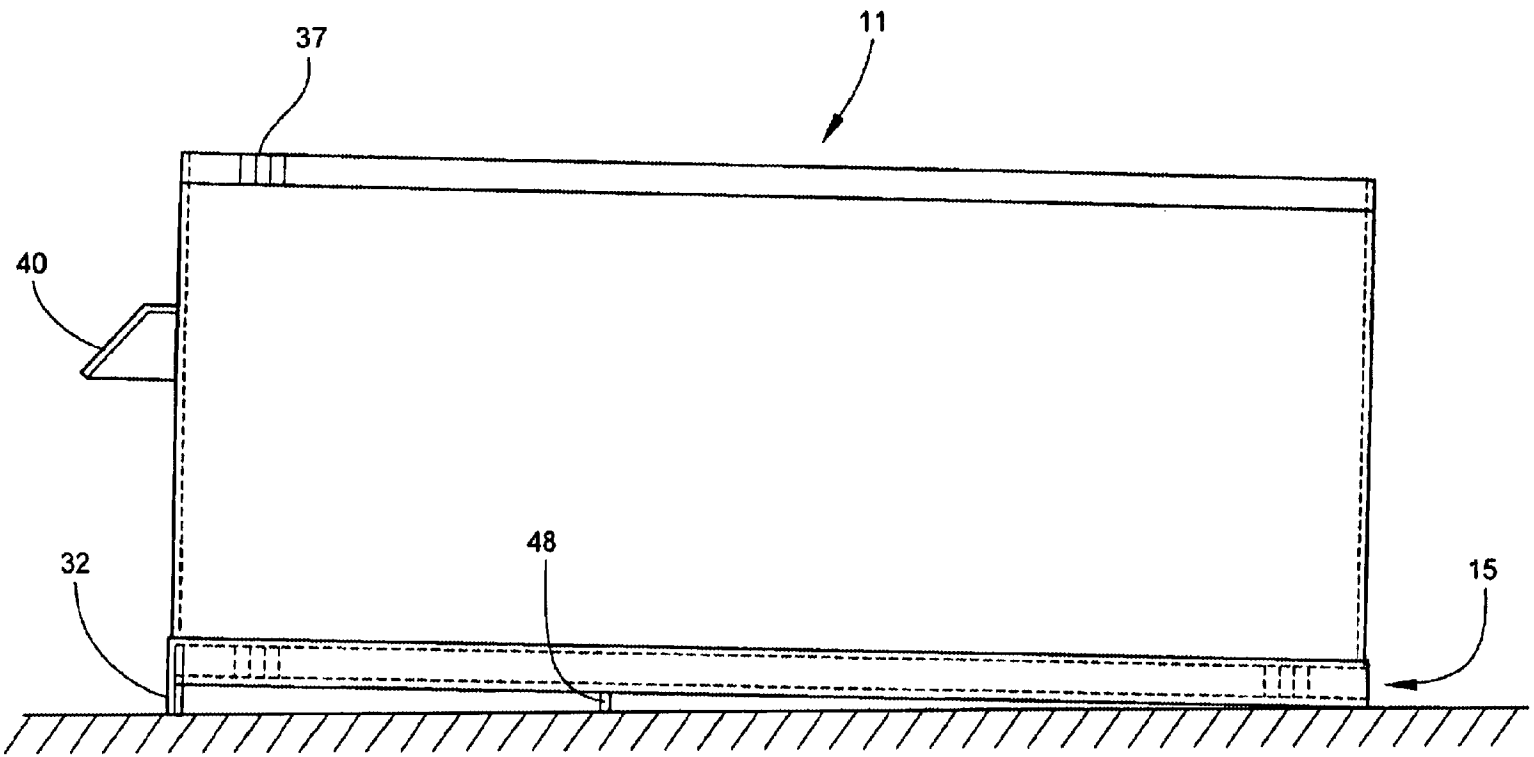
FIG. 13 is an elevation of the drawer assembly in a third configuration.

A third configuration of the drawer assembly 11 is shown in FIG. 13. In this configuration, the lid 15 is applied to the bottom rails 41, 42 from the front of drawer 14, and slides rearwardly to align the detents 38, 39 of the lid channels 25, 26 with corresponding laterally-opposed rear indents 51 (only one shown) formed with the bottom rails 41 and 42. The mating detents 36, 37 and indents 51 cooperate to temporarily lock the lid 15 in position. This configuration is particularly useful for storing the lid 15 when using the drawer assembly 11 outside the cabinet 10.

A reconfigurable drawer assembly is described above. Various details of the invention may be changed without departing from its scope. Furthermore, the foregoing description of the preferred embodiment of the invention and best mode for practicing the invention are provided for the purpose of illustration only and not for the purpose of limitation—the invention being defined by the claims.

I claim:

1. A drawer assembly, comprising:

(a) a drawer having a bottom wall, first and second opposing end walls, and first and second opposing side walls, and said end and side walls cooperating to define an open top for receiving and removing contents;

(b) first and second longitudinal top rails formed with respective first and second side walls;

(c) a removable lid adapted for covering the open top of said drawer in a first assembly configuration, said lid having first and second opposing major surfaces, first and second opposing end edges, and first and second opposing side edges, the side edges comprising respective longitudinal channels adapted for receiving the longitudinal top rails of said drawer to slide said lid over the open top;

(d) an indent formed with at least one of said first and second longitudinal top rails of said drawer;

(e) a detent formed with at least one of said first and second longitudinal channels of said lid and adapted for mating with said indent of said drawer to temporarily lock said lid in position over the open top of said drawer: and (f) first and second longitudinal bottom rails formed with respective first and second side walls below respective too rails, and adapted for receiving the longitudinal channels of said removable lid to position said lid adjacent the bottom wall of said drawer in a second assembly configuration.

2. A drawer assembly according to claim 1, and comprising an indent formed with at least one of said first and second bottom rails of said drawer, and adapted for mating with said detent formed with the longitudinal channel of said lid to temporarily lock said lid in position adjacent the bottom wall of said drawer in the second assembly configuration.

3. A drawer assembly according to claim 1, wherein each of the longitudinal channels of said lid defines a beveled end adapted to facilitate sliding of said lid onto said drawer.

4. A drawer assembly according to claim 1, wherein said lid comprises a pull flange located at one end edge and extending vertically outwardly beyond the first major surface of said lid to be pulled by a user to uncover said lid from the open top of said drawer in the first assembly configuration.

5. A drawer assembly, comprising:

(a) a drawer having a bottom wall, first and second opposing end walls, and first and second opposing side walls, and said end and side walls cooperating to define an open top for receiving and removing contents;

(b) first and second longitudinal top rails formed with respective first and second side walls;

(c) a removable lid adapted for covering the open top of said drawer in a first assembly configuration, and having first and second opposing major surfaces, first and second opposing end edges, and first and second opposing side edges, the side edges comprising respective longitudinal channels adapted for receiving the longitudinal top rails of said drawer to slide said lid over the open top;

(d) first and second laterally-opposed indents formed with respective longitudinal top rails of said drawer;

(e) first and second laterally-opposed detents formed with respective longitudinal channels of said lid and adapted for mating with said first and second indents of said drawer to temporarily lock said lid in position over the open top of said drawer;

(f) first and second longitudinal bottom rails formed with respective first and second side walls below respective top rails, and adapted for receiving the longitudinal channels of said removable lid to position said lid adjacent the bottom wall of said drawer in a second assembly configuration; and (g) first and second laterally-opposed indents formed with respective longitudinal bottom rails of said drawer, and adapted for mating with said first and second detents formed with respective longitudinal channels of said removable lid to temporarily lock said lid in position adjacent the bottom wall of said drawer.

6. A storage cabinet defining cells, and a plurality of like drawer assemblies stored in respective cells, each of said drawer assemblies comprising:

(a) a drawer having a bottom wall, first and second opposing end walls, and first and second opposing side walls, and said end and side walls cooperating to define an open top for receiving and removing contents;

(b) first and second longitudinal top rails formed with respective first and second side walls;

(c) a removable lid adapted for covering the open top of said drawer in a first assembly configuration, and having first and second opposing major surfaces, first and second opposing end edges, and first and second opposing side edges, the side edges comprising respective longitudinal channels adapted for receiving the longitudinal top rails of said drawer to slide said lid over the open top;

(d) first and second indents formed with respective longitudinal top rails of said drawer; and (e) first and second detents formed with respective longitudinal channels of said lid and adapted for mating with said first and second indents of said drawer to temporarily lock said lid in position over the open top of said drawer, and (f) first and second longitudinal bottom rails formed with respective first and second side walls of said drawer below respective top rails, and adapted for receiving the longitudinal channels of said removable lid to position said lid adjacent the bottom wall of said drawer in a second assembly configuration.

7. A storage cabinet according to claim 6, and comprising first and second indents formed with respective longitudinal bottom rails of said drawer, and adapted for mating with said first and second detents formed with respective longitudinal channels of said lid to temporarily lock said lid in position adjacent the bottom wall of said drawer in the second assembly configuration.

8. A storage cabinet according to claim 7, wherein said removable lid comprises a pull flange located at one end edge and extending vertically outwardly beyond the first major surface of said lid to be pulled by a user to uncover said lid from the open top of said drawer in the first assembly configuration.

9. A storage cabinet according to claim 8, and comprising a vertically raised bottom lip formed at a mouth of each cell.

10. A storage cabinet according to claim 9, wherein said removable lid further comprises a lateral stop located between said first and second end edges, and extending vertically outwardly beyond the first major surface of said lid, such that when said lid is positioned adjacent the bottom wall of said drawer in the second assembly configuration with the second major surface of said lid facing the bottom wall, said lateral stop engages the bottom lip of the cell to limit outward sliding movement of said drawer from said cabinet.

11. A storage cabinet according to claim 10, wherein the pull flange of said lid extends beyond the lateral stop, such that when said drawer is pushed inside said cabinet with said lid positioned adjacent the bottom wall of said drawer in the second assembly configuration, said pull flange tilts said drawer forward thereby moving contents by gravity towards a front of the drawer.

12. A storage cabinet according to claim 6, wherein each of said longitudinal channels defines a beveled end adapted to facilitate sliding of said lid onto said drawer.

13. A storage cabinet according to claim 6, and comprising a handle attached to the end wall of said drawer for being pulled by a user.

14. A drawer assembly, comprising:

(a) a drawer having a bottom wall, first and second opposing end walls, and first and second opposing side walls, and said end and side walls cooperating to define an open top for receiving and removing contents;

(b) first and second longitudinal top rails formed with respective first and second side walls;

(c) a removable lid adapted for covering the open top of said drawer in a first assembly configuration, said lid having first and second opposing major surfaces, first and second opposing end edges, and first and second opposing side edges, the side edges comprising respective longitudinal channels adapted for receiving the longitudinal top rails of said drawer to slide said lid over the open top, and each of the longitudinal channels of said lid defining a beveled end adapted to facilitate sliding of said lid onto said drawer;

(d) an indent formed with at least one of said first and second longitudinal top rails of said drawer; and (e) a detent formed with at least one of said first and second longitudinal channels of said lid and adapted for mating with said indent of said drawer to temporarily lock said lid in position over the open top of said drawer.

15. A drawer assembly, comprising:

(a) a drawer having a bottom wall, first and second opposing end walls, and first and second opposing side walls, and said end and side walls cooperating to define an open top for receiving and removing contents;

(b) first and second longitudinal top rails formed with respective first and second side walls;

(c) a removable lid adapted for covering the open top of said drawer in a first assembly configuration, said lid having first and second opposing major surfaces, first and second opposing end edges, and first and second opposing side edges, the side edges comprising respective longitudinal channels adapted for receiving the longitudinal top rails of said drawer to slide said lid over the open top, and said lid comprising a pull flange located at one end edge and extending vertically outwardly beyond the first major surface of said lid to be pulled by a user to uncover said lid from the open top of said drawer in the first assembly configuration;

(d) an indent formed with at least one of said first and second longitudinal top rails of said drawer; and (e) a detent formed with at least one of said first and second longitudinal channels of said lid and adapted for mating with said indent of said drawer to temporarily lock said lid in position over the open top of said drawer.

* * * * *